US011674228B2

(12) United States Patent
Sato

(10) Patent No.: US 11,674,228 B2
(45) Date of Patent: Jun. 13, 2023

(54) FILM FORMATION DEVICE AND FILM FORMATION METHOD FOR METAL PLATING FILM

(71) Applicant: TOYOTA JIDOSHA KABUSHIKI KAISHA, Toyota (JP)

(72) Inventor: Yuki Sato, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 15 days.

(21) Appl. No.: 17/547,541

(22) Filed: Dec. 10, 2021

(65) Prior Publication Data

US 2022/0186378 A1 Jun. 16, 2022

(30) Foreign Application Priority Data

Dec. 15, 2020 (JP) ..... JP2020-207356

(51) Int. Cl.
*C23C 18/16* (2006.01)
*B05C 1/06* (2006.01)
*B05C 3/18* (2006.01)

(52) U.S. Cl.
CPC ..... *C23C 18/1664* (2013.01); *B05C 1/06* (2013.01); *B05C 3/18* (2013.01); *C23C 18/1637* (2013.01); *C23C 18/1698* (2013.01)

(58) Field of Classification Search
None
See application file for complete search history.

(56) References Cited

U.S. PATENT DOCUMENTS 4,100,331 A * 7/1978 Fletcher ..... H01M 4/86 429/498
4,865,888 A * 9/1989 Akahoshi ..... C23C 18/1619 118/410
6,504,688 B2 * 1/2003 Hasegawa ..... B82Y 10/00 360/324.11
8,262,957 B2 * 9/2012 Fukushima ..... C04B 35/63444 264/44
8,839,003 B2 * 9/2014 Tani ..... G06F 21/6209 713/193
8,946,088 B2 * 2/2015 Boxall ..... H01L 21/02697 257/E21.174

(Continued)

FOREIGN PATENT DOCUMENTS

JP 2005-307309 A 11/2005
JP 2011-042831 A 3/2011

*Primary Examiner* — Jethro M. Pence
(74) *Attorney, Agent, or Firm* — Sughrue Mion, PLLC

(57) ABSTRACT

Provided is a device and a method for forming a metal plating film having a thick film thickness by a solid substitution-type electroless plating method. The present disclosure relates to a film formation device for forming a film of a first metal on a plating film of a second metal by a solid substitution-type electroless plating method, comprising: a conductive mounting base; a third metal; an insulating material; a microporous membrane; a plating bath chamber; and a pressing unit, wherein the third metal has an ionization tendency larger than ionization tendencies of the first metal and the second metal, and wherein the insulating material is installed between a base material and the third metal so as to contact respective materials of the base material and the third metal when the base material having the plating film of the second metal is installed.

9 Claims, 4 Drawing Sheets

(56) References Cited

U.S. PATENT DOCUMENTS 9,677,185 B2 * 6/2017 Sato ..... C25D 17/10
9,818,514 B2 * 11/2017 Arnold ..... C23C 18/31
9,865,884 B2 * 1/2018 Kongkanand ..... C25D 15/02
9,949,374 B2 * 4/2018 Takemoto ..... C23C 18/1651
11,062,826 B2 * 7/2021 Arnold ..... C23C 18/50
11,142,826 B2 * 10/2021 Han ..... C23C 18/1637
11,505,867 B1 * 11/2022 Freiderich ..... C25F 7/00
2003/0150353 A1 * 8/2003 Kato ..... C23C 18/44
106/1.23
2006/0234079 A1 * 10/2006 Zhang ..... H01L 21/76259
427/430.1
2007/0071888 A1 * 3/2007 Shanmugasundram .....
H01L 21/76879
156/345.31
2008/0234527 A1 * 9/2008 Matsumoto ..... C07C 5/367
585/483
2009/0223701 A1 * 9/2009 Idomoto ..... H05K 3/0014
428/137
2010/0109651 A1 * 5/2010 Tolmachev ..... G01N 27/043
324/149
2010/0258954 A1 * 10/2010 Andoh ..... H01L 24/85
257/784
2011/0042816 A1 2/2011 Fujiwara et al.
2012/0064243 A1 * 3/2012 Akay ..... C23C 18/31
427/243
2013/0143071 A1 * 6/2013 Kleinle ..... C23C 18/1689
29/458
2014/0017410 A1 * 1/2014 Kale ..... C23C 18/1658
427/353
2014/0275418 A1 * 9/2014 Dyanov ..... C09D 5/00
524/858
2016/0024675 A1 * 1/2016 Hiraoka ..... C25D 3/12
205/271
2016/0040290 A1 * 2/2016 Chyan ..... C23C 18/1675
427/434.2
2016/0362792 A1 * 12/2016 Yoshida ..... B32B 15/04
2019/0300372 A1 * 10/2019 Lin ..... C01B 32/186
2020/0343580 A1 * 10/2020 Yushin ..... H01M 10/44
2020/0407853 A1 * 12/2020 Iisaka ..... C23C 18/31
2021/0079531 A1 * 3/2021 Iisaka ..... C23C 28/023
2022/0002877 A1 * 1/2022 Elsharkawi ..... C23C 18/1689
2022/0119956 A1 * 4/2022 Iisaka ..... C23C 18/31

* cited by examiner

FILM FORMATION DEVICE AND FILM FORMATION METHOD FOR METAL PLATING FILM

CROSS REFERENCE TO RELATED APPLICATIONS

The present application claims priority from Japanese patent application JP 2020-207356 filed on Dec. 15, 2020, the entire content of which is hereby incorporated by reference into this application.

BACKGROUND

Technical Field

The present disclosure relates to a film formation device and a film formation method for a metal plating film (also simply referred to as a "film" in this specification or the like).

Description of Related Art

Generally, a method for plating by reducing metal ions in a plating bath (here, the "plating bath" is also referred to as a "plating solution") is roughly divided into an electroplating method using an external current and an electroless plating method not using an external electricity. The latter electroless plating method is further roughly divided into (1) a substitution-type electroless plating method where metal ions in a solution are reduced by electrons, which are released by dissolution of an object to be plated, and deposited on the object to be plated, and (2) an autocatalytic reduction-type electroless plating method where metal ions in a solution are deposited as a metal film by electrons released when a reducing agent contained in the solution is oxidized. Since the electroless plating method allows uniform deposition even on a surface in a complicated shape, the electroless plating method is widely used in many fields.

In the substitution-type electroless plating, a difference in ionization tendency between a metal in a plating bath and an underlying metal is used to form a metal plating film. For example, in a gold plating method, when a substrate on which an underlying metal is formed is immersed in a plating bath, the underlying metal having a high ionization tendency becomes ions to be dissolved in the plating bath, and gold ions in the plating bath are deposited on the underlying metal as a metal to form a gold plating film. The substitution-type electroless plating is widely used mainly for oxidation prevention of an underlying material metal and a foundation of autocatalytic-type plating.

For example, JP 2005-307309 A discloses a substitution-type electroless plating bath using the substitution-type electroless plating method. JP 2005-307309 A discloses an electroless gold plating bath to form a gold plating film on an electroless nickel plating film, and the electroless gold plating bath contains (a) a water-soluble gold compound, (b) a conductive salt containing an acidic substance having an acid dissociation constant (pKa) of 2.2 or less, and (c) an oxidation inhibitor containing a heterocyclic aromatic compound having two or more nitrogen atoms in a molecule as essential components.

JP 2011-42831 A discloses a manufacturing method of a semiconductor apparatus using an electroless plating method. In JP 2011-42831 A, to manufacture the semiconductor apparatus including a surface electrode on a semiconductor substrate, the method includes a step of forming a metal electrode film on a surface of the semiconductor substrate and a plating layer formation step of forming a nickel plating layer on a surface of the metal electrode film by an electroless nickel plating process. A concentration of elements of sodium and potassium remaining on the surface of the metal electrode film before the plating layer formation step is $9.20\times10^{14}$ atoms/cm$^2$ or less in total, and a concentration of elements of sodium and potassium contained in an electroless nickel plating bath used for the electroless nickel plating process is 3400 wtppm or less in total.

SUMMARY

The formation of the metal plating film by an electroplating method has an advantage of fast film forming rate. On the other hand, in the formation of the metal plating film by the electroplating method, uniform metal film formation is difficult. For example, to form a gold plating film on nickel, a substitution reaction between the nickel and gold generates local corrosion and therefore the uniform gold film formation is difficult, resulting in reduced solder wettability.

The formation of the metal plating film by the electroless plating method has an advantage that allows the uniform metal film formation. On the other hand, in the formation of the metal plating film by the electroless plating method, the film forming rate is slow and therefore obtaining a thick film thickness is difficult, resulting in high cost. This is because when a foundation is covered with a metal by the electroless plating method, a deposition reaction of the metal stops and the maximum film thickness becomes only around 0.2 μm.

Therefore, nowadays, in the electroless plating method, a solid phase method that allows forming the metal plating film at a high speed has been gathering attention.

A Solid Electroless Deposition (SELD) method includes a solid substitution-type electroless plating method and a solid reduction-type electroless plating method. The solid substitution-type electroless plating method is a method, in which a microporous membrane, such as a solid electrolyte membrane, is installed between a substitution-type electroless plating bath containing ions of a first metal and a second metal having an ionization tendency larger than that of the first metal (or the second metal plated on a metal base material) and the first metal is deposited on a surface of the second metal by causing a redox reaction derived from a difference in the ionization tendency between the metals, which are the first metal in an ionic state that have passed through the microporous membrane and the second metal as an underlying metal, to form a metal plating film made of the first metal on the surface of the second metal. The solid reduction-type electroless plating method is a method, in which a microporous membrane is installed between a reduction-type electroless plating bath containing ions of a second metal and a metal base material and the second metal is deposited on a surface of the metal base material by causing a redox reaction between the ions of the second metal that have passed through the microporous membrane and a reductant contained in the reduction-type electroless plating bath to form a plating film of the second metal on the surface of the metal base material.

The present disclosure provides a device and a method for forming a metal plating film having a thick film thickness by a solid phase method, especially, a solid substitution-type electroless plating method.

As a result of intensive studies, the inventor has found the following. In forming a film of a first metal on a plating film of a second metal by a solid substitution-type electroless plating method, a film formation device is used. The film formation device includes a conductive mounting base, a third metal, an insulating material, a microporous membrane, a plating bath chamber, and a pressing unit. The conductive mounting base is adapted to install a base material (substrate) having the plating film of the second metal. The third metal is installed on the conductive mounting base. The third metal has an ionization tendency larger than ionization tendencies of the first metal and the second metal. The insulating material is installed on the conductive mounting base. When the base material having the plating film of the second metal is installed, the insulating material is installed between the base material and the third metal so as to contact respective materials of the base material and the third metal [that is, base material (surface of the base material on which the plating film of the second metal is not formed) and the third metal]. The microporous membrane is adapted to be impregnated with a substitution-type electroless plating bath containing ions of the first metal. The substitution-type electroless plating bath containing the ions of the first metal is delivered to the plating film of the second metal on the base material through the microporous membrane. The plating bath chamber is provided with an opening portion in which the microporous membrane is installed. The plating bath chamber is adapted to house the substitution-type electroless plating bath containing the ions of the first metal. The pressing unit is adapted to relatively press the plating bath chamber and the base material against each other after bringing the microporous membrane and the plating film of the second metal on the base material into contact with each other. By the use of the film formation device, a local anode reaction of the third metal causes a local cathode reaction of the first metal, and a substitution reaction between the first metal and the second metal is promoted, thereby allowing forming the plating film of the first metal having the thick film thickness. Thus, the inventor achieved the present disclosure.

That is, the gist of the present disclosure is as follows.

(1) A film formation device for forming a film of a first metal on a plating film of a second metal by a solid substitution-type electroless plating method. The film formation device comprises a conductive mounting base, a third metal, an insulating material, a microporous membrane, a plating bath chamber, and a pressing unit. The conductive mounting base is adapted to install a base material having the plating film of the second metal. The third metal is installed on the conductive mounting base. The insulating material is installed on the conductive mounting base. The microporous membrane is adapted to be impregnated with a substitution-type electroless plating bath containing ions of the first metal. The sub stitution-type electroless plating bath containing the ions of the first metal is delivered to the plating film of the second metal on the base material through the microporous membrane. The plating bath chamber is provided with an opening portion in which the microporous membrane is installed. The plating bath chamber is adapted to house the substitution-type electroless plating bath containing the ions of the first metal. The pressing unit is adapted to relatively press the plating bath chamber and the base material against each other after bringing the microporous membrane and the plating film of the second metal on the base material into contact with each other. The third metal has an ionization tendency larger than ionization tendencies of the first metal and the second metal. The insulating material is installed between the base material and the third metal so as to contact respective materials of the base material and the third metal when the base material having the plating film of the second metal is installed.

(2) In the film formation device according to (1), when the base material having the plating film of the second metal is installed, the base material having the plating film of the second metal, the third metal, and the insulating material have a same height and become flush.

(3) In the film formation device according to (1) or (2), the conductive mounting base has a protruding portion at a position at which the third metal is installed, the protruding portion has a width (here, width is a length in a direction in which the base material, the insulating material, and the third metal are arranged) a same as a width of the third metal, and the third metal is installed on the protruding portion of the conductive mounting base.

(4) In the film formation device according to any one of (1) to (3), the third metal is aluminum or iron.

(5) In the film formation device according to any one of (1) to (4), the insulating material contains an insulating polymer.

(6) In the film formation device according to any one of (1) to (5), the base material is a copper base material, the first metal is gold, and the second metal is nickel.

(7) A method for forming a film of a first metal on a plating film of a second metal by a solid substitution-type electroless plating method. The method comprises: (i) installing a base material having the plating film of the second metal on a conductive mounting base such that a surface of the base material opposite to a surface on which the plating film of the second metal is formed contacts the conductive mounting base; (ii) installing a third metal on the conductive mounting base, the third metal having an ionization tendency larger than ionization tendencies of the first metal and the second metal; (iii) installing an insulating material between the base material and the third metal on the conductive mounting base such that the insulating material contacts respective materials of the base material and the third metal; (iv) installing a microporous membrane such that the microporous membrane contacts the plating film of the second metal on the base material; (v) installing a substitution-type electroless plating bath containing ions of the first metal such that the substitution-type electroless plating bath containing the ions of the first metal contacts the microporous membrane; and (vi) relatively pressing a plating bath chamber and the base material against each other, the plating bath chamber housing the substitution-type electroless plating bath containing the ions of the first metal.

(8) In the method according to (7), the third metal is aluminum or iron.

(9) In the method according to (7) or (8), the base material is a copper base material, the first metal is gold, and the second metal is nickel.

Effects

The present disclosure provides the device and the method for forming the metal plating film having the thick film thickness by the solid substitution-type electroless plating method.

DETAILED DESCRIPTION OF THE EMBODIMENTS

Figure 1:
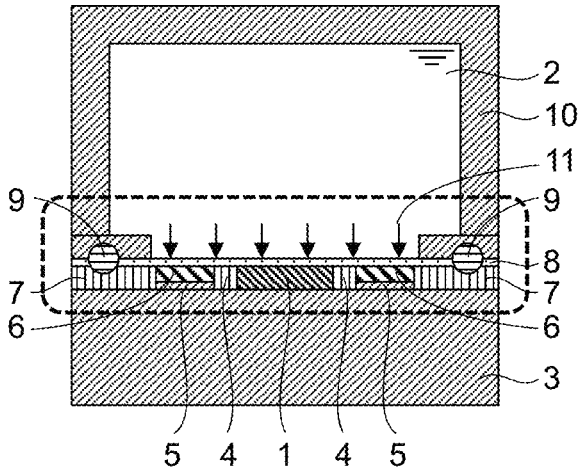
FIG. 1 is a cross-sectional view schematically illustrating a state of performing a solid substitution-type electroless plating method using an exemplary film formation device of the present disclosure.

The following describes appropriate embodiments of the present disclosure in detail.

In this specification, features of the present disclosure will be described with reference to the drawings as necessary. In the drawings, dimensions and shapes of respective components are exaggerated for clarification, and actual dimensions and shapes are not accurately illustrated. Accordingly, the technical scope of the present disclosure is not limited to the dimensions and the shapes of the respective components illustrated in the drawings. Note that, a film formation device and a film formation method for a metal plating film of the present disclosure is not limited to the embodiments bellow, and can be performed in various configurations where changes, improvements, and the like which a person skilled in the art can make are given without departing from the gist of the present disclosure.

The present disclosure relates to a film formation device for forming a film of a first metal on a plating film of a second metal by a solid substitution-type electroless plating method. The film formation device comprises a conductive mounting base, a third metal, an insulating material, a microporous membrane, a plating bath chamber, and a pressing unit. The conductive mounting base is adapted to install a base material having the plating film of the second metal. The third metal is installed on the conductive mounting base. The insulating material is installed on the conductive mounting base. The microporous membrane is adapted to be impregnated with a substitution-type electroless plating bath containing ions of the first metal. The substitution-type electroless plating bath containing the ions of the first metal is delivered to the plating film of the second metal on the base material through the microporous membrane. The plating bath chamber is provided with an opening portion in which the microporous membrane is installed. The plating bath chamber is adapted to house the substitution-type electroless plating bath containing the ions of the first metal. The pressing unit is adapted to relatively press the plating bath chamber and the base material against each other after bringing the microporous membrane and the plating film of the second metal on the base material into contact with each other. The third metal has an ionization tendency larger than ionization tendencies of the first metal and the second metal. The insulating material is installed between the base material and the third metal so as to contact respective materials of the base material and the third metal when the base material having the plating film of the second metal is installed.

The following describes constituent materials of the film formation device of the present disclosure in detail.

(Mounting Base)

The mounting base is a base adapted to install the base material having the plating film of the second metal, and has a conductive property. While the mounting base is not limited as long as the mounting base is made of a material having the conductive property, for example, mounting bases made of titanium and made of stainless steel are included.

Since the mounting base has the conductive property, electrons emitted from the third metal can move to the base material and the plating film of the second metal formed on the base material via the mounting base, thus allowing promoting the film formation of the first metal on the plating film of the second metal.

The mounting base may include protruding portions each having the same width as a width of the third metal (here, the width is a length in a direction in which the base material, the insulating material, and the third metal are arranged) at portions on which the third metal is installed, and for example, the protruding portions usually have a height of 0.1 mm to 10 mm, and 1 mm to 2 mm in some embodiments although not limited.

Since the mounting base has the protruding portion, the seal performance of the mounting base with the insulating material and the third metal is improved, thus allowing avoiding soaking of the substitution-type electroless plating bath into the film formation device. Furthermore, since the mounting base has the protruding portions, the amount of the third metal to be used can be reduced.

(Third Metal)

The third metal is a metal to form a local cell with the plating film of the second metal on the base material via the conductive mounting base, installed on the conductive mounting base, and has the large ionization tendency compared with the first metal and the second metal. The third metal includes an alloy containing two or more metals.

The standard electrode potential (Z) [V vs NHE] of the third metal is usually $-3.045\ V \leq Z < -0.277\ V$ and may be $-2.714\ V \leq Z \leq -0.338\ V$.

Examples of the third metal include magnesium, beryllium, aluminum, titanium, zirconium, manganese, zinc, and iron. From a perspective of ease of procurement and processing, the third metal may be aluminum or iron. The third metal may be aluminum.

The third metal may be removably installed on the conductive mounting base. Since the third metal is removable, even if the third metal is worn by performing the solid substitution-type electroless plating method, the worn third metal can be easily replaced with the new third metal.

The third metal is installed to be in contact with at least one, for example, two insulating materials to be brought in contact with the base material on the conductive mounting base. The third metal may be installed to be in close contact with the insulating material.

The third metal can have any shape according to the shape of the conductive mounting base and the shape of the insulating material. The shape of the third metal includes, for example, a plate-shaped object, such as a flat plate shape or a curved plate shape.

When the third metal is the plate-shaped object, although not limited, an average thickness (height) of the third metal is usually 0.1 mm to 10 mm, and may be 1 mm to 5 mm. Although not limited, a width of the third metal (here, the width is a length in the direction in which the base material, the insulating material, and the third metal are arranged) is usually 2 mm to 10 mm. Although not limited, a depth of the third metal (here, the depth is a length in a direction perpendicular to the width) is usually shorter than the length of the depth of the base material by 0 mm to 5 mm. The third metal may have the height the same as the heights of the insulating material and the base material having the plating film of the second metal when the base material having the plating film of the second metal is installed in the film formation device of the present disclosure. Note that when the conductive mounting base includes the protruding portion having the width (here, the width is a length in the direction in which the base material, the insulating material, and the third metal are arranged) the same as the width of the third metal at the portion at which the third metal is installed, the third metal may have the height including the height of the protruding portion the same as the heights of the insulating material and the base material having the plating film of the second metal when the base material having the plating film of the second metal is installed in the film formation device of the present disclosure. Since the third metal has such a height, when the microporous membrane contacts not only the plating film of the second metal on the base material, but also the insulating material installed in contact with the base material and the third metal installed in contact with the insulating material, the microporous membrane contacts the plating film of the second metal on the base material, the insulating material, and the third metal, which are arranged to be mutually in contact having the same height so as to be flush, thus providing a contact surface between the microporous membrane and these materials without unevenness. The contact surface between the microporous membrane and these materials without unevenness allows suppressing the damage on the microporous membrane. Furthermore, only the contact surface between the microporous membrane and these materials is possibly contaminated by performing the method of the present disclosure, thus also facilitating the cleaning.

(Insulating Material)

The insulating material is a material installed to avoid a corrosion of a contact portion possibly caused by directly bringing the base material and the third metal into contact with each other, especially, a corrosion possibly significantly caused when a liquid component such as a plating bath soaks into the contact portion. The insulating material is installed on the conductive mounting base to be in contact with the third metal, and to be in close contact with the third metal in some embodiments. When the base material having the plating film of the second metal is installed, the insulating material is installed between the base material (surface of the base material on which the plating film of the second metal is not formed) and the third metal so as to be in contact with the respective materials [that is, the base material (the surface of the base material on which the plating film of the second metal is not formed) and the third metal]. That is, the insulating material is installed such that the base material, the insulating material, and the third metal are arranged to be mutually in contact, and to be mutually in close contact in some embodiments, on the conductive mounting base in the order of base material-insulating material-third metal, third metal-insulating material-base material, or third metal-insulating material-base material-insulating material-third metal.

While the insulating material is not specifically limit as long as the insulating property is provided, for example, an insulating polymer may be used. The insulating polymer is a polymer that does not flow electricity. Although not especially limited, examples of the insulating polymer include polyolefin, such as polypropylene (PP) and polytetrafluoroethylene (PTFE), engineering plastics, such as polyamide (PA), polyphenylene sulfide (PPS), and polyetheretherketone (PEEK), elastomer, such as fluorine rubber and silicon rubber, and thermosetting resin, such as unsaturated polyester. Since the insulating material is the insulating polymer, the installation to the conductive mounting base is facilitated, and the replacement is easy in the case of damage.

The insulating material may be bonded to the conductive mounting base by an adhesive or the like, and/or assembled to the conductive mounting base by processing or the like. With the insulating material bonded and/or assembled to the mounting base, the seal performance between the mounting base and the insulating material is improved, thus allowing the avoidance of soaking of the substitution-type electroless plating bath into the device.

The insulating material can have any shape according to the shape of the base material and the shape of the third metal. The insulating material is a plate-shaped object having, for example, a flat plate shape or a curved plate shape.

When the insulating material is the plate-shaped object, although not limited, an average thickness (height) of the insulating material is usually 0.1 mm to 20 mm, and may be 1 mm to 7 mm. Although not limited, a width of the insulating material (here, the width is a length in the direction in which the base material, the insulating material, and the third metal are arranged) is usually 1 mm to 5 mm. Although not limited, a depth of the insulating material (here, the depth is a length in the direction perpendicular to the width) is usually longer than the length of the depth of the base material by 0 mm to 5 mm. The insulating material may have the height the same as the heights of the third metal and the base material having the plating film of the second metal when the base material having the plating film of the second metal is installed in the film formation device of the present disclosure. Since the insulating material has such a height, when the microporous membrane contacts not only the plating film of the second metal on the base material, but also the insulating material installed in contact with the base material and the third metal installed in contact with the insulating material, the microporous membrane contacts the plating film of the second metal on the base material, the insulating material, and the third metal, which are arranged to be mutually in contact having the same height so as to be flush, thus providing a contact surface between the microporous membrane and these materials without unevenness. The contact surface between the microporous membrane and these materials without unevenness allows suppressing the damage on the microporous membrane. Furthermore, only the contact surface between the microporous membrane and these materials is possibly contaminated by performing the method of the present disclosure, thus also facilitating the cleaning.

For example, when the base material is a columnar body and has the plating film of the second metal on one of the bottom surfaces of the base material, the insulating material is installed so as to be in contact with at least a part of the side surface of the base material. For example, when the base material has a rectangular parallelepiped shape and has the plating film of the second metal on one of its surfaces, the insulating material is installed so as to be in contact with at least one surface, for example, opposing two surfaces of the four surfaces excluding the surface on which the plating film of the second metal is formed and its opposite surface of the base material. The insulating material may be installed so as to be in close contact with the surface of the base material on which the plating film of the second metal is not formed when the base material having the plating film of the second metal is installed.

The insulating material may be installed so as to sandwich the third metal, that is, in the order of -insulating material-third metal-insulating material-.

(Microporous Membrane)

The microporous membrane is a porous film adapted to be impregnated with the substitution-type electroless plating bath containing the ions of the first metal. The substitution-type electroless plating bath containing the ions of the first metal is delivered to the plating film of the second metal on the base material through the microporous membrane. The microporous membrane is installed in the opening portion of the plating bath chamber described below. The microporous membrane can be internally impregnated with the substitution-type electroless plating bath containing the ions of the first metal through the contact with the substitution-type electroless plating bath containing the ions of the first metal and by being applied with a pressure. The microporous membrane is not specifically limited as long as the substitution-type electroless plating bath containing the ions of the first metal can be passed through to the surface of the plating film of the second metal in the solid substitution-type electroless plating method.

The microporous membrane may be a film-like one like a separator, and may be formed of a fiber like a nonwoven fabric. While a hole diameter of the microporous membrane is not limited, the hole diameter is usually 0.01 μm to 100 μm, and 0.1 μm to 100 μm in some embodiments.

The microporous membrane may have an anionic group. When the microporous membrane has the anionic group, the anionic group can capture the ions of the second metal dissolved from the second metal and the ions of the third metal dissolved from the third metal. Therefore, the deterioration of the substitution-type electroless plating bath due to the ions of the second metal (for example, nickel ions) derived from the second metal and the ions of the third metal (for example, aluminum ions or iron ions) derived from the third metal can be suppressed. Since the microporous membrane having the anionic group is hydrophilic, the wettability is improved. Therefore, since the microporous membrane having the anionic group is easily wettable by the substitution-type electroless plating bath, the substitution-type electroless plating bath can be uniformly spread on the second metal. Consequently, the microporous membrane having the anionic group also provides an effect that the uniform metal plating film can be formed.

While the anionic group is not specifically limited, the anionic group is at least one kind selected from, for example, a sulfonic acid group, a thiosulfonic acid group (—$S_2O_3H$), a carboxyl group, a phosphoric acid group, a phosphonic acid group, a hydroxyl group, a cyano group, or a thiocyano group. These anionic groups can capture ions of metal having positive electric charges. These anionic groups can give the hydrophilicity to the microporous membrane. The anionic group may be a sulfonic acid group or a carboxyl group. Especially, the anionic group may be a sulfonic acid group (sulfo group) because nickel ions can be effectively captured.

As a material of the microporous membrane having the anionic group, an anionic polymer can be used. That is, the microporous membrane having the anionic group contains the anionic polymer. The anionic polymer has the anionic group (for example, the sulfonic acid group, the thiosulfonic acid group, the carboxyl group, the phosphoric acid group, the phosphonic acid group, the hydroxyl group, the cyano group, or the thiocyano group described above). The anionic polymer may have one kind of the anionic group alone, or may have two kinds or more of the anionic groups in combination. The anionic group may be the sulfonic acid group.

While the anionic polymer is not specifically limited, the anionic polymer can contain, for example, a polymer containing a monomer having the anionic group.

Representatively, the anionic polymer includes, for example, a polymer having the carboxyl group [for example, a (meth)acrylic acid polymer (for example, a copolymer of (meth)acrylic acid, such as poly(meth)acrylic acid, and another copolymerizable monomer), or a fluorine-based resin having the carboxyl group (perfluorocarboxylic acid resin)], a styrene-based resin having the sulfonic acid group [for example, polystyrene sulfonic acid], and a sulfonated polyarene ether-based resin [for example, sulfonated polyether ketone resin and sulfonated polyethersulfone resin].

The microporous membrane may be a solid electrolyte membrane having an ionic conductivity. The solid electrolyte membrane internally has a cluster structure, and this cluster structure is internally impregnated with the substitution-type electroless plating bath. When the solid electrolyte membrane has the anionic group, since the ions of the first metal, such as gold ions, in the substitution-type electroless plating bath are coordinated to the anionic group in the solid electrolyte membrane, the ions of the first metal are effectively diffused into the solid electrolyte membrane. Therefore, the use of the solid electrolyte membrane allows uniformly forming the metal plating film.

The solid electrolyte membrane has a porous structure (that is, cluster structure), and pores of the porous structure are very small, having an average pore diameter of usually from 0.1 μm to 100 μm. By applying a pressure, the substitution-type electroless plating bath can be impregnated into the solid electrolyte membrane.

The solid electrolyte membrane may be a fluorine-based resin having a sulfonic acid group. The fluorine-based resin having the sulfonic acid group has a hydrophobic part of a fluorinated carbon skeleton and a hydrophilic part of a side chain part having the sulfonic acid group, and these parts form the ion cluster. The ions of the first metal in the substitution-type electroless plating bath impregnated to inside the ion cluster are coordinated to the sulfonic acid group of the solid electrolyte membrane, and uniformly diffused into the solid electrolyte membrane. Since the solid electrolyte membrane having the sulfonic acid group is easily wettable by the substitution-type electroless plating bath because of high hydrophilicity and excellent wettability, the substitution-type electroless plating bath can be uniformly spread on the second metal. Therefore, the use of the fluorine-based resin having the sulfonic acid group allows the formation of the uniform metal plating film. Furthermore, the use of the fluorine-based resin having the sulfonic acid group increases dielectric polarization generated at a diffusion layer present between the solid electrolyte membrane and the second metal due to Maxwell-Wagner effect, thus allowing high speed transport of the ions of the first metal. Such a fluorine-based resin is available as, for example, a series of a product name "Nafion" from DuPont.

The Equivalent Weight (EW) of the solid electrolyte membrane is usually from 850 g/mol to 950 g/mol, and may be from 874 g/mol to 909 g/mol. The respective upper limit values and lower limit values of these numerical ranges can be combined among them as necessary to specify an appropriate range. Here, the equivalent weight means a dry mass of the solid electrolyte membrane per equivalent of an ion exchange group. When the equivalent weight of the solid electrolyte membrane is in this range, the uniformity of the metal plating film can be improved.

While an adjustment method of the equivalent weight of the solid electrolyte membrane is not specifically limited, for example, in the case of a perfluorocarbon sulfonic acid polymer, the adjustment can be performed by changing a polymerization ratio between a fluorinated vinyl ether compound and a fluorinated olefin monomer. Specifically, for example, by increasing the polymerization ratio of the fluorinated vinyl ether compound, the equivalent weight of the solid electrolyte membrane to be obtained can be decreased. The equivalent weight can be measured using a titration method.

A film thickness of the microporous membrane is usually from 10 μm to 200 μm and may be from 20 μm to 160 μm. The respective upper limit values and lower limit values of these numerical ranges can be combined among them as necessary to specify an appropriate range. When the film thickness of the microporous membrane is 10 μm or more, the microporous membrane is not easily broken and has an excellent durability. When the film thickness of the microporous membrane is 200 μm or less, the pressure necessary for causing the substitution-type electroless plating bath to pass through the microporous membrane can be reduced.

A water contact angle of the microporous membrane is usually 15° or less, may be 13° or less, and may be 10° or less. When the water contact angle of the microporous membrane is within this range, the wettability of the microporous membrane can be improved.

While the microporous membrane (including solid electrolyte membrane) can include, for example, a fluorine-based resin, such as POREFLON (registered trademark) WPW-045-80 manufactured by Sumitomo Electric Industries, Ltd., and Nafion (registered trademark) manufactured by DuPont, a hydrocarbon-based resin, a polyamic acid resin, and a resin having an ion exchange function, such as Selemion (CMV, CMD, CMF series) manufactured by AGC Inc., the microporous membrane is not limited to them.

While the microporous membrane only needs to have a size enough to cover the plating film of the second metal on the base material, the microporous membrane may have a size enough to cover the insulating material to be installed in contact with the base material and the third metal installed in contact with the insulating material.

(Plating Bath Chamber)

The plating bath chamber is a container adapted to house the substitution-type electroless plating bath containing the ions of the first metal. The plating bath chamber is made of a metallic material, a resin material, or the like, and is provided with an opening portion for bringing the substitution-type electroless plating bath and the microporous membrane into contact with each other. Accordingly, the microporous membrane is installed in the opening portion of the plating bath chamber. Note that since the substitution-type electroless plating bath is housed in a space defined by the plating bath chamber and the microporous membrane, oxidation of the substitution-type electroless plating bath can be suppressed. Therefore, an oxidation inhibitor does not have to be added to the substitution-type electroless plating bath. Moreover, sealing the substitution-type electroless plating bath with the plating bath chamber and the microporous membrane allows facilitating eutectoid of hydrogen in the plating film, and as a result, solder wettability can be improved.

(Pressing Unit)

The pressing unit is a unit adapted to relatively press the plating bath chamber against the base material after bringing the microporous membrane and the plating film of the second metal on the base material into contact with each other. The pressing unit is also a unit that impregnates the microporous membrane with the substitution-type electroless plating bath containing the ions of the first metal and further delivers the impregnated substitution-type electroless plating bath containing the ions of the first metal to the plating film of the second metal. While the pressing unit is not limited as long as the unit applies a pressure from the substitution-type electroless plating bath toward the microporous membrane and the plating film of the second metal on the base material, the pressing unit can include, for example, a pressing unit using a fluid pressure.

While the pressure that can be applied by the pressing unit is not limited as long as the pressure can impregnate the microporous membrane with the substitution-type electroless plating bath and deliver the substitution-type electroless plating bath to the plating film of the second metal on the base material, the pressure is usually from 0.1 MPa to 3 MPa, and may be from 0.2 MPa to 1 MPa.

By operating the pressing unit, the substitution-type electroless plating bath containing the ions of the first metal housed in the plating bath chamber is impregnated into the microporous membrane, the ions of the first metal pass through the microporous membrane and contact the surface of the plating film of the second metal, which is in contact with the microporous membrane, on the base material, thereby causing the formation of the plating film of the first metal by the solid substitution-type electroless plating method.

Next, a description will be given of a method for forming a film of the first metal on the plating film of the second metal of the base material having the plating film of the second metal by the solid substitution-type electroless plating method using the film formation device of the present disclosure.

First, in the film formation device of the present disclosure, the base material having the plating film of the second metal is installed on the conductive mounting base such that the surface of the base material on which the plating film of the second metal is not formed contacts the conductive mounting base and the insulating material, and further, the microporous membrane contacts the plating film of the second metal when the microporous membrane is installed.

Here, the base material has the plating film of the second metal on the surface. The base material is an object on which the plating film is formed, and may be a copper base material. The copper base material is a base material made of copper or an alloy containing copper. The base material can have any shape. The shape of the base material includes, for example, a plate-shaped object, such as a flat plate shape (rectangular parallelepiped shape) or a curved plate shape, a rod-shaped object, or a spherical-shaped object. The base material may be an object on which fine processing, such as a groove and a hole, is performed, and may be, for example, a wiring for an electronic industrial component, such as a printed wiring board, an ITO substrate, and a ceramic IC package substrate. The base material may be a plating film formed on a resin product, a glass product, or a product, such as a ceramic component. The base material may be a copper substrate made of copper.

When the base material is the plate-shaped object, an average thickness of the base material is usually from 0.1 mm to 20 mm and may be from 1 mm to 7 mm including the thickness of the plating film of the second metal. Although not limited, the width (here, the width is a length in the direction in which the base material, the insulating material, and the third metal are arranged) is usually from 2 mm to 20 mm. Although not limited, the depth (here, the depth is a length in the direction perpendicular to the width) is usually from 2 mm to 20 mm. The base material may have the height the same as the heights of the third metal and the insulating material when the base material is installed in the film formation device of the present disclosure. Since the base material has such a height, when the microporous membrane contacts not only the plating film of the second metal on the base material, but also the insulating material installed in contact with the base material and the third metal installed in contact with the insulating material, the microporous membrane contacts the plating film of the second metal on the base material, the insulating material, and the third metal, which are arranged to be mutually in contact having the same height so as to be flush, thus providing a contact surface between the microporous membrane and these materials without unevenness. The contact surface between the microporous membrane and these materials without unevenness allows suppressing the damage on the microporous membrane. Furthermore, only the contact surface between the microporous membrane and these materials is possibly contaminated by performing the method of the present disclosure, thus also facilitating the cleaning.

The second metal has the ionization tendency larger than that of the first metal and the ionization tendency smaller than that of the third metal.

The standard electrode potential (Y) [V vs NHE] of the second metal is usually $-0.277\ V \leq Y < 0.337\ V$ and may be $-0.257\ V \leq Y < 0.337\ V$.

Examples of the second metal include lead, tin, and nickel. From a perspective of undercoat plating, in other words, a barrier layer, in an electronic component, the second metal may be nickel.

In the present disclosure, the method for forming the plating film of the second metal by depositing the second metal on the surface of the base material, such as the copper base material, is not limited, and the known technique in the technical field, such as an electroplating method and an electroless plating method, is usable. The method for forming the plating film of the second metal by depositing the second metal on the surface of the base material may be a solid phase method or may be a solid electro deposition method or a solid electroless deposition method. The Solid Electro Deposition (SED) method is a method for forming a metal plating film made of a metal on a surface of a base material by installing a microporous membrane such as a solid electrolyte membrane between an anode and the base material that serves as a cathode, bringing the microporous membrane into contact with the base material and applying a voltage between the anode and the base material, and depositing the metal on the surface of the base material from metal ions contained in the microporous membrane. The use of the solid phase method, especially, the solid electro deposition method or the solid electroless deposition method, for example, the solid reduction-type electroless plating method allows the formation of the metal plating film having a thick film thickness at high speed.

An average film thickness of the second metal plated on the base material is usually from 2 μm to 50 μm and may be from 5 μm to 30 μm. Note that the average film thickness is a value found by averaging film thicknesses at 10 positions measured with, for example, a microscope image.

Subsequently, the plating bath chamber, which is provided with the opening portion in which the microporous membrane is installed to house the substitution-type electroless plating bath containing the ions of the first metal, is installed such that the plating film of the second metal on the base material and the microporous membrane are brought in contact with each other.

Note that, while the microporous membrane only needs to cover the plating film of the second metal on the base material, the microporous membrane may cover the insulating material installed in contact with the base material and the third metal installed in contact with the insulating material.

The plating bath chamber houses the substitution-type electroless plating bath containing the ions of the first metal. The substitution-type electroless plating bath may be housed any time as long as it is before the solid substitution-type electroless plating method is performed.

Here, the first metal has the ionization tendency smaller than those of the second metal and the third metal.

The standard electrode potential (X) [V vs NHE] of the first metal is usually $0.337\ V < X \leq 1.830\ V$.

Examples of the first metal include gold, palladium, rhodium, and silver. From a perspective of absence of a surface-oxidized film as a basic condition of assembly, ease of deformation because of its flexibility, and ease of avoidance of an interface void, the first metal may be gold.

The substitution-type electroless plating bath is a plating solution used in the substitution-type electroless plating method. The substitution-type electroless plating bath, for example, contains a metal compound containing the ions of the first metal and a complexing agent and may contain an additive as necessary. Examples of the additive include a pH buffer agent or a stabilizer. A commercially available substitution-type electroless plating bath may be used.

The substitution-type electroless plating bath is, for example, a substitution-type electroless gold plating bath in which the first metal is gold. Hereinafter, the substitution-type electroless gold plating bath will be described in detail.

The substitution-type electroless gold plating bath at least contains a gold compound and a complexing agent and may contain an additive as necessary. Note that since the substitution-type electroless gold plating bath does not contain a reductant, management and an operation of the bath are comparatively easy.

While the gold compound is not specifically limited, the gold compound includes, for example, a cyanide gold salt or a non-cyanide gold salt. The cyanide gold salt includes a gold cyanide, a gold potassium cyanide, a gold sodium cyanide, a gold ammonium cyanide, or the like. The non-cyanide gold salt includes a gold sulfite salt, a gold thiosulfate salt, a chloroaurate, a gold thiomalate, or the like. One kind of gold salt may be used alone, or two or more kinds may be used in combination. As the gold salt, from the aspect of handling, environment, and toxicity, the non-cyanide gold salt may be used, and the gold sulfite salt among the non-cyanide gold salt may be used. The gold sulfite salt can include, for example, a gold ammonium sulfite, a gold potassium sulfite, a gold sodium sulfite, a methanesulfonic acid gold salt, or the like.

Content of the gold compound in the substitution-type electroless gold plating bath as gold is usually from 0.5 g/L to 2.5 g/L and may be from 1.0 g/L to 2.0 g/L. The respective upper limit values and lower limit values of these numerical ranges can be combined among them as necessary to specify an appropriate range. When the content of the gold is 0.5 g/L or more, the deposition reaction of the gold can be improved. Additionally, when the content of the gold is 2.5 g/L or less, stability of the substitution-type electroless gold plating bath can be improved.

The complexing agent provides effects to stably complex gold ions ($Au^+$) and to decrease the occurrence of a disproportionation reaction of $Au^+$ ($3Au^+ \rightarrow Au^{3+} + 2Au$), thereby improving the stability of the substitution-type electroless gold plating bath. One kind of the complexing agent may be used alone, or two or more kinds may be used in combination.

The complexing agent includes, for example, a cyanide complexing agent or a non-cyanide complexing agent. The cyanide complexing agent includes, for example, sodium cyanide or potassium cyanide. The non-cyanide complexing agent includes, for example, sulfite, thiosulfate, thiomalate, thiocyanate, mercaptosuccinic acid, mercaptoacetic acid, 2-mercaptopropionic acid, 2-aminoethanethiol, 2-mercaptoethanol, glucose cysteine, 1-thioglycerol, sodium mercaptopropane sulfonate, N-acetyl methionine, thiosalicylic acid, ethylenediaminetetraacetic acid (EDTA), and pyrophosphoric acid. As the complexing agent, from the aspect of handling, environment, and toxicity, the non-cyanide complexing agent may be used, and the sulfite among the non-cyanide complexing agent may be used.

The content of the complexing agent in the substitution-type electroless gold plating bath is usually from 1 g/L to 200 g/L, and may be from 20 g/L to 50 g/L. The respective upper limit values and lower limit values of these numerical ranges can be combined among them as necessary to specify an appropriate range. When the content of the complexing agent is 1 g/L or more, a gold complexing ability is increased to allow improvement in the stability of the substitution-type electroless gold plating bath. When the content of the complexing agent is 200 g/L or less, generation of recrystallization in the substitution-type electroless gold plating bath can be suppressed.

The substitution-type electroless gold plating bath can contain the additive as necessary. The additive includes, for example, a pH buffer agent or a stabilizer.

The pH buffer agent can adjust a deposition rate to a desired value, and can keep pH of the substitution-type electroless gold plating bath constant. One kind of the pH buffer agent may be used alone, or two or more kinds may be used in combination. The pH buffer agent includes, for example, phosphate, acetate, carbonate, borate, citrate, or sulfate.

The pH of the substitution-type electroless gold plating bath is usually from 5.0 to 8.0, may be from 6.0 to 7.8, and may be from 6.8 to 7.5. The respective upper limit values and lower limit values of these numerical ranges can be combined among them as necessary to specify an appropriate range. When the pH is 5.0 or more, the stability of the substitution-type electroless gold plating bath tends to be improved. When the pH is 8.0 or less, corrosion of the metal base material as the underlying metal can be suppressed. The pH can be adjusted by adding, for example, potassium hydroxide, sodium hydroxide, and ammonium hydroxide.

The stabilizer can improve the stability of the substitution-type electroless gold plating bath. The stabilizer includes, for example, a thiazole compound, a bipyridyl compound, or a phenanthroline compound.

A commercially available substitution-type electroless gold plating bath may be used. The commercial product includes, for example, EPITHAS TDS-25, TDS-20 (manufactured by C. Uyemura & Co., Ltd.), or FLASH GOLD (manufactured by OKUNO CHEMICAL INDUSTRIES CO., LTD.).

After the base material having the plating film of the second metal and the substitution-type electroless plating bath are installed in the film formation device of the present disclosure, the plating bath chamber that houses the substitution-type electroless plating bath and the base material are relatively pressed against each other by the pressing unit, thus starting the solid substitution-type electroless plating method.

By relatively pressing the plating bath chamber and the base material against each other, the substitution-type electroless plating bath containing the ions of the first metal housed in the plating bath chamber is impregnated into the microporous membrane, the ions of the first metal pass through the microporous membrane and contact the plating film of the second metal, which is in contact with the microporous membrane, on the base material, thereby causing the formation of the plating film of the first metal by the solid substitution-type electroless plating method.

In the solid substitution-type electroless plating method of the present disclosure, a reaction temperature (temperature of the plating bath chamber) is usually from 20° C. to 95° C. and may be from 70° C. to 90° C., a reaction time (plating time) is usually from 30 seconds to 1 hour and may be from 1 minute to 30 minutes, and a pressure applied between the plating bath chamber housing the substitution-type electroless plating bath containing the ions of the first metal and the base material or the insulating material is usually from 0.1 MPa to 3 MPa and may be from 0.2 MPa to 1 MPa. Setting the reactive conditions in the ranges allows the film formation at an appropriate deposition rate and allows suppressing decomposition of components in the plating bath.

Accordingly, the present disclosure further relates to a method for forming a film of a first metal on a plating film of a second metal by a solid substitution-type electroless plating method. The method includes: (i) installing a base material having the plating film of the second metal on a conductive mounting base such that a surface of the base material opposite to a surface on which the plating film of the second metal is formed contacts the conductive mounting base; (ii) installing a third metal on the conductive mounting base, the third metal having an ionization tendency larger than ionization tendencies of the first metal and the second metal; (iii) installing an insulating material between the base material and the third metal on the conductive mounting base such that the insulating material contacts respective materials of the base material and the third metal; (iv) installing a microporous membrane such that the microporous membrane contacts the plating film of the second metal on the base material; (v) installing a substitution-type electroless plating bath containing ions of the first metal such that the substitution-type electroless plating bath containing the ions of the first metal contacts the microporous membrane; and (vi) relatively pressing a plating bath chamber and the base material against each other, the plating bath chamber housing the substitution-type electroless plating bath containing the ions of the first metal.

The process sequence of (i) to (v) is not limited as long as a relative positional relationship among the conductive mounting base, the base material having the plating film of the second metal, the third metal, the insulating material, the microporous membrane, and the substitution-type electroless plating bath containing the ions of the first metal is one as described in the film formation device and the film formation method of the present disclosure.

It is inferred that a reaction described below occurs in the present disclosure. As a result, the effect of the present disclosure can be obtained. Note that the present disclosure is not limited to the following inference.

When the microporous membrane containing the substitution-type electroless plating bath containing the ions of the first metal is brought into contact with the plating film of the second metal having the ionization tendency larger than that of the first metal, the plating film of the second metal becomes ions and are dissolved in the substitution-type electroless plating bath. Meanwhile, in a reaction in which the ions of the first metal derived from the substitution-type electroless plating bath are reduced and deposited on the surface of the plating film of the second metal to form the plating film of the first metal, the surface on which the plating film of the second metal is not formed of the base material on which the plating film of the second metal is formed is brought into contact with the conductive mounting base, the mounting base and the third metal are brought into contact with each other, and the base material and the third metal are separated by the insulating material, thereby forming a local cell between the second metal and the third metal via the conductive mounting base. Consequently, a local anode reaction of the third metal progresses and the electrons generated by the reaction induce a local cathode reaction of the first metal on the second metal via the conductive mounting base. In association with this, the substitution reaction between the first metal and the second metal, that is, the film formation of the first metal on the plating film of the second metal, is promoted, thereby allowing uniformly forming the plating film of the first metal having the thick film thickness.

Figure 2:
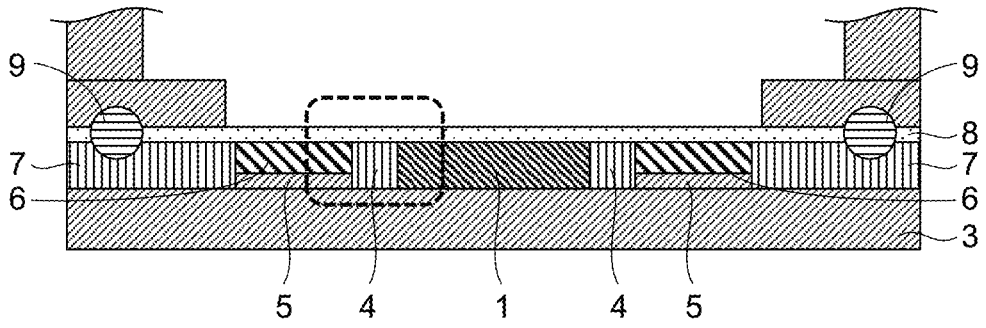
FIG. 2 is an enlarged view of a part indicated by a dotted line in FIG. 1.

FIG. 1 is a cross-sectional view schematically illustrating a state of performing a solid substitution-type electroless plating method using an exemplary film formation device of the present disclosure. FIG. 2 is an enlarged view of a part indicated by a dotted line in FIG. 1.

The film formation device illustrated in FIG. 1 includes a rectangular parallelepiped base material 1 having a plating film of a second metal and a substitution-type electroless plating bath 2 containing ions of a first metal. The film formation device of FIG. 1 includes a conductive mounting base 3, the base material 1 having the plating film of the second metal, two rectangular parallelepiped insulating materials 4, two rectangular parallelepiped third metals 6, two rectangular parallelepiped additional insulating materials 7, a microporous membrane 8, retainers 9 for retaining the microporous membrane 8, the substitution-type electroless plating bath 2 disposed to be in contact with the microporous membrane 8, a plating bath chamber 10, and a pressing unit (not illustrated). The base material 1 is installed on the conductive mounting base 3 while having the plating film of the second metal upward. The two insulating materials 4 are installed to be in close contact with two side surfaces of the base material 1. The two third metals 6 are installed on protruding portions 5 of the conductive mounting base 3 so as to be in close contact with the two insulating materials 4. The two additional insulating materials 7 are installed outside the two third metals 6 so as to be in close contact with the two third metals 6. The microporous membrane 8 is installed so as to be in contact with the plating film of the second metal on the base material 1, the two insulating materials 4, the two third metals 6, and the two additional insulating materials 7. The plating bath chamber 10 houses the substitution-type electroless plating bath 2. The pressing unit is adapted to relatively press the plating bath chamber 10 and the base material 1 against each other. In the film formation device illustrated in FIG. 1, by operating the pressing unit, a pressure 11 is applied to the microporous membrane 8 from the substitution-type electroless plating bath 2 toward the base material 1, and the substitution-type electroless plating bath 2 is delivered to the plating film of the second metal on the base material 1, thus starting the film formation method of the present disclosure.

Figure 3:
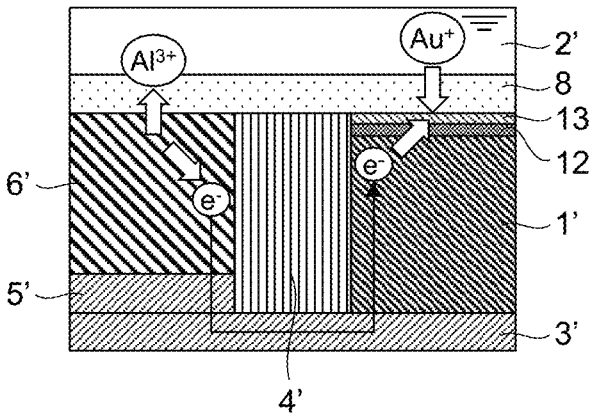
FIG. 3 is a drawing illustrating moves of electrons in the solid substitution-type electroless plating method of the present disclosure using a further enlarged view of a part indicated by a dotted line in FIG. 2.

For example, in a case where gold is used as the first metal, nickel is used as the second metal, a copper substrate 1' is used as the base material 1, a substitution-type electroless gold plating bath 2' is used as the substitution-type electroless plating bath 2 containing the ions of the first metal, a titanium mounting base 3' is used as the conductive mounting base 3, a PEEK 4' is used as the insulating material 4, and an aluminum plate 6' is used as the third metal 6, a description will be given of moves of electrons in the solid substitution-type electroless plating method of the present disclosure using FIG. 3 illustrating a further enlarged view of a part indicated by a dotted line in FIG. 2.

When the microporous membrane 8 containing the substitution-type electroless gold plating bath 2' is brought into contact with a nickel plating film 12 having the ionization tendency larger than that of the gold, the nickel plating film 12 becomes ions and are dissolved in the substitution-type electroless gold plating bath 2'. Meanwhile, in a reaction in which the gold ions derived from the substitution-type electroless gold plating bath 2' are reduced and deposited on the surface of the nickel plating film 12 to form a gold plating film 13, the surface on which the nickel plating film 12 is not formed of the copper substrate 1' on which the nickel plating film 12 is formed is brought into contact with the titanium mounting base 3', the titanium mounting base 3' (protruding portions 5' of titanium mounting base 3') and the aluminum plate 6' are brought into contact with each other, and the copper substrate 1' and the aluminum plate 6' are separated by the PEEK 4', thereby forming a local cell between the nickel and the aluminum via the titanium mounting base 3'. A local anode reaction of the aluminum plate 6' occurs in the local cell and the electrons generated by the reaction flow from the aluminum plate 6' to the nickel plating film 12 via the titanium mounting base 3' and the copper substrate 1', and therefore a proportion of the supply of the electrons to the nickel plating film 12 increases. As a result, a local cathode reaction of the gold on the nickel is induced, and in association with this, the substitution reaction between the gold and the nickel, that is, the film formation of the gold plating film 13 on the nickel plating film 12, is promoted, thereby allowing uniformly forming the gold plating film 13 having the thick film thickness.

[Substitution Reaction]

$Au^{+}+e^{-}\rightarrow Au$ (+1.830 V)

$Ni\rightarrow Ni^{2+}+2e^{-}$ (−0.257 V)

[Local Cathode Reaction]

$Au^{+}+e^{-}\rightarrow Au$ (+1.830 V)

[Local Anode Reaction]

$Al\rightarrow Al^{3+}3e^{-}$ (−1.680 V)

Note that in the local cell, because of the difference in ionization tendency between the two kinds of metals, the noble (higher) part of the electric potential (small ionization tendency) becomes the cathode and the base (lower) part of the electric potential (large ionization tendency) becomes the anode, and thus a current flows. Note that, for example, a difference in magnitude of strain or magnitude of the metal crystal grains, a difference in orientation of the crystals, or a weight ratio also becomes a cause of the local cell, simply not only the difference in the magnitude of the ionization tendency of the mutual metals. Since the local cell is in a state of being short-circuited by metal phases, the local current flows.

The average film thickness of the first metal plated on the second metal is usually from 0.01 μm to 25 μm and may be from 0.2 μm to 2.5 μm. Note that the average film thickness is a value found by averaging film thicknesses at 10 positions measured with, for example, a microscope image or a SEM image.

To deposit the first metal on the surface of the second metal plated on the base material by the solid substitution-type electroless plating method and form the plating film of the first metal, the use of the film formation device of the present disclosure provides an effect that the metal plating film can be formed by the use of a small amount of the plating bath. That is, the conventional electroless plating method generally comprises immersing an object to be plated in the plating bath to form a plating film on the object to be plated. To immerse the object to be plated in the plating bath, a comparatively large amount of plating bath may be used. Meanwhile, the amount of plating bath to be used in the film formation device of the present disclosure is actually only the amount impregnated into the microporous membrane and therefore the amount is smaller than the conventional amount used to immerse the object to be plated. Therefore, the method according to the present disclosure allows forming the metal plating film by the use of the small amount of the plating bath.

Furthermore, in the film formation device of the present disclosure, the third metal that is possibly worn by performing the solid substitution-type electroless plating method is installed to be separated by the insulating material and parallel to the base material on the mounting base the same as the conductive mounting base on which the base material is installed, not on the surface of the base material on which the plating film of the second metal is not formed. By disposing the third metal in this manner, even when the third metal is worn by performing the solid substitution-type electroless plating method, the third metal can be easily replaced. Even when the third metal becomes ions and dissolved out, the microporous membrane can be easily removed and cleaned.

A plating laminated body including the base material, the film of the second metal formed on the base material, and the film of the first metal formed on the second metal manufactured in the present disclosure can be used, for example, as a power element upper electrode.

EXAMPLE

While the present disclosure will be further described in detail using the example below, the technical scope of the present disclosure is not limited thereto.

Example 1

Using the film formation device described with FIGS. 1 to 3, gold as the first metal was deposited on a surface of the nickel as the second metal by the solid substitution-type electroless plating method under the following conditions to form a gold plating film.

<Film Formation Conditions by Solid Substitution-Type Electroless Plating Method with Gold>

Substitution-type electroless gold plating bath: TDS-25 (manufactured by C. Uyemura & Co., Ltd.)

Microporous membrane: POREFLON WPW-045-80 (manufactured by Sumitomo Electric Industries, Ltd.)

Base material: nickel plating film/copper substrate

Third metal: aluminum plate

Insulating material: PEEK

Temperature: 70° C.

Film formation time: 6 minutes

Pressurization method: hydraulic press

Pressure: about 0.2 MPa

Figure 4:
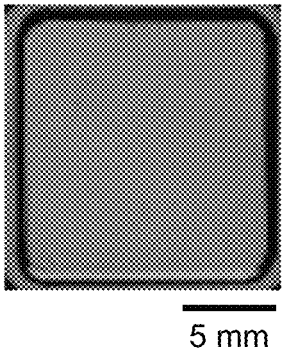
FIG. 4 is a photograph of a gold plating film formed by Example 1.

FIG. 4 illustrates a photograph of the obtained gold plating film. As illustrated in FIG. 4, the use of the film formation device and the film formation method of the present disclosure allowed normally forming the gold plating film on the nickel plating film on the copper substrate.

All publications, patents and patent applications cited in the present description are herein incorporated by reference as they are.

What is claimed is:

1. A film formation device for forming a film of a first metal on a plating film of a second metal by a solid substitution electroless plating method, the film formation device comprising:

a conductive mounting base adapted to install a base material having the plating film of the second metal;

a third metal installed on the conductive mounting base;

an insulating material installed on the conductive mounting base;

a microporous membrane adapted to be impregnated with a substitution electroless plating bath containing ions of the first metal, the substitution electroless plating bath containing the ions of the first metal being delivered to the plating film of the second metal on the base material through the microporous membrane;

a plating bath chamber provided with an opening portion in which the microporous membrane is installed, the plating bath chamber being adapted to house the substitution electroless plating bath containing the ions of the first metal; and a press adapted to relatively press the plating bath chamber and the base material against each other after bringing the microporous membrane and the plating film of the second metal on the base material into contact with each other, wherein the third metal has an ionization tendency larger than ionization tendencies of the first metal and the second metal, and wherein the insulating material is installed between the base material and the third metal so as to contact respective materials of the base material and the third metal when the base material having the plating film of the second metal is installed.

2. The film formation device according to claim 1, wherein when the base material having the plating film of the second metal is installed, the base material having the plating film of the second metal, the third metal, and the insulating material have a same height and become flush.

3. The film formation device according to claim 1, wherein the conductive mounting base has a protruding portion at a position at which the third metal is installed, the protruding portion has a width (here, width is a length in a direction in which the base material, the insulating material, and the third metal are arranged) a same as a width of the third metal, and the third metal is installed on the protruding portion of the conductive mounting base.

4. The film formation device according to claim 1, wherein the third metal is aluminum or iron.

5. The film formation device according to claim 1, wherein the insulating material contains an insulating polymer.

6. The film formation device according to claim 1, wherein the base material is a copper base material, the first metal is gold, and the second metal is nickel.

7. A method for forming a film of a first metal on a plating film of a second metal by a solid substitution electroless plating method, the method comprising:

(i) installing a base material having the plating film of the second metal on a conductive mounting base such that a surface of the base material opposite to a surface on which the plating film of the second metal is formed contacts the conductive mounting base;

(ii) installing a third metal on the conductive mounting base, the third metal having an ionization tendency larger than ionization tendencies of the first metal and the second metal;

(iii) installing an insulating material between the base material and the third metal on the conductive mounting base such that the insulating material contacts respective materials of the base material and the third metal;

(iv) installing a microporous membrane such that the microporous membrane contacts the plating film of the second metal on the base material;

(v) installing a substitution electroless plating bath containing ions of the first metal such that the substitution electroless plating bath containing the ions of the first metal contacts the microporous membrane; and (vi) relatively pressing a plating bath chamber and the base material against each other, the plating bath chamber housing the substitution electroless plating bath containing the ions of the first metal.

8. The method according to claim 7, wherein the third metal is aluminum or iron.

9. The method according to claim 7, wherein the base material is a copper base material, the first metal is gold, and the second metal is nickel.

* * * * *